US005323839A

United States Patent [19]

Matsuo et al.

[11] Patent Number: 5,323,839

[45] Date of Patent: * Jun. 28, 1994

[54] MOLD FOR FORMING A COLLAR ON AN EXTERNAL PERIPHERY OF A METAL CAP

[75] Inventors: Hiroto Matsuo, Nagoya; Takashi Imakoma, Aichi; Iwaji Kawamoto; Seiichi Kondo, both of Nagoya, all of Japan

[73] Assignee: NGK Insulators, Ltd., Nagoya, Japan

[ * ] Notice: The portion of the term of this patent subsequent to Mar. 22, 2011 has been disclaimed.

[21] Appl. No.: 41,166

[22] Filed: Apr. 1, 1993

Related U.S. Application Data

[63] Continuation of Ser. No. 782,765, Oct. 22, 1991, which is a continuation of Ser. No. 493,609, Mar. 15, 1990, abandoned.

[30] Foreign Application Priority Data

Mar. 20, 1989 [JP] Japan ..... 1-69005

[51] Int. Cl.[5] ..... B22D 17/24

[52] U.S. Cl. ..... 164/332; 164/342; 249/83; 249/85

[58] Field of Search ..... 164/98, 100, 101, 102, 164/112, 332, 228, 9, 11, 23, 30, 342; 249/83, 85

[56] References Cited

U.S. PATENT DOCUMENTS

| | | | |
|---|---|---|---|
| 2,745,437 | 5/1956 | Comstock | 164/332 |

FOREIGN PATENT DOCUMENTS

| | | | |
|---|---|---|---|
| 869251 | 3/1953 | Fed. Rep. of Germany | 164/228 |
| 55-081063 | 6/1980 | Japan | 164/98 |
| 1235646 | 6/1986 | U.S.S.R. | 164/332 |
| 2103534 | 2/1983 | United Kingdom | 164/332 |
| 2193132 | 2/1988 | United Kingdom | 164/228 |

*Primary Examiner*—Paula A. Bradley
*Assistant Examiner*—Rex E. Pelto

[57] ABSTRACT

The invention is directed to a method and a mold for forming a zinc collar on an insulator metal cap. The zinc collar forming mold is composed of a setting section for setting the metal cap in position on the mold and an upwardly opening cavity defined around the periphery of the setting section. For molding a zinc collar, the metal cap is immersed in a molten zinc, and the metal cap is set upright on the setting section of the mold with the lower half thereof being still in the molten state. Subsequently, a molten zinc is poured from the upper opening of the mold, and upon solidification of the molten zinc, a zinc collar can be formed around the external circumference of the metal cap.

1 Claim, 3 Drawing Sheets

MOLD FOR FORMING A COLLAR ON AN EXTERNAL PERIPHERY OF A METAL CAP

This is a continuation of application Ser. No. 07/782,765 filed Oct. 22, 1991 now allowed, which is a continuation of application Ser. No. 07/493,609 filed Mar. 15, 1990 now abandoned.

BACKGROUND OF THE INVENTION

1. Field of the Invention

This invention relates to a method of forming a zinc collar on an insulator metal cap and a mold therefor.

2. Description of the Prior Art

Suspension insulators are generally used in the form of an insulator string comprising a multiplicity of serially connected insulators interposed between transmission lines and the arms of steel towers for supporting the transmission lines in order to secure insulation to the earth. However, if the surfaces of these suspension insulators are polluted and wetted, leakage current flows over the ceramic surfaces of the suspension insulators, whereby the metal caps undergo electrolytic corrosion to cause thinning thereof. Accordingly, the metal caps come to have reduced strength and they may occasionally be damaged by the load of the transmission lines.

With a view to overcoming the above problems, a suspension insulator, for example, of the structure shown in FIG. 4 has been proposed. This type of conventional suspension insulator has a pin 2 in the cavity of the head 1*a* of the insulator body 1 and fixed with a cement 3, and also has a metal cap 4 having a socket 4*a*. The metal cap 4 with which a pin 2 of another insulator unit can be engaged is fixed with a cement 5 over the circumference of the head 1*a* of the insulator body 1, wherein a zinc collar 6 is integrally formed on the metal cap 4 from the lower external circumferential edge to the bottom for the purpose of preventing such electrolytic corrosion of the metal cap 4.

In forming such zinc collar 6, the following method has conventionally been employed, wherein a metal cap 4 molded through casting of a metallic material such as iron is subjected to pretreatment (degreasing and acid washing) and then to galvanizing, followed by solidification of the thus deposited molten zinc with water cooling. The thus treated metal cap 4 is then dipped upright in a molten zinc 11 as shown in FIG. 5 so that approximately the lower half of the entire cap height may be immersed in the molten zinc 11, and removed therefrom to allow approximately the lower half of the metal cap 4 to be soaked with the molten zinc. Subsequently, as shown in FIG. 6, the metal cap 4 is set on a preheated mold 12 which can be separated into halves. A molten zinc 13 is poured from a sprue 12*b* of the mold 12, which passes through a gate 12*c* and flows into a zinc collar molding cavity 12*a*, followed by solidification of the molten zinc 13 to form a zinc collar 6 on the metal cap 4 from the lower external circumferential edge to the bottom.

Nevertheless, in the above conventional zinc collar forming method, the mold requires a high-accuracy approaching/separating mechanism, since the zinc collar 6 is designed to be formed using a pair of separable die halves, so that the mold assembly comes to have an extremely complicated structure. Moreover, since when the metal cap is released from the mold, the solidified zinc is snatched off at the gate 12*c*, burrs are formed on the zinc collar surface along the gate 12*c*, requiring intricate procedures such as deburring and subsequent finish polishing. Further, the molten zinc 13 also stays in the sprue 12*b* and the gate 12*c*, extra amount of zinc must be used. For such reasons, production costs inevitably jump up disadvantageously.

In the conventional molding method, the zinc collar molding cavity 12*a* of the mold 12 has a closed structure, so that the solidification of the molten zinc 13 poured into the cavity 12*a* proceeds from the external and internal circumferential surfaces of the zinc collar 6 toward the internal portion thereof. Thus, voids (micropores) are liable to be formed in the internal portion of the zinc collar 6 and products can be formed in very low yield, disadvantageously.

SUMMARY OF THE INVENTION

This invention has been accomplished in view of such problems inherent in the prior art, and one object of this invention is to provide a method of forming a zinc collar on the insulator metal cap which uses a simplified mold structure without requiring any high-accuracy approaching/separating mechanism for the mold.

Another object of this invention is to provide a method of forming a zinc collar, which can not only obviate intricate procedures of deburring and subsequent finish polishing since no burring which may otherwise be caused due to the presence of gate occurs on the surface of the zinc collar, but also minimize the amount of molten zinc.

Still another object of this invention is to provide a method of forming a zinc collar which assures prevention of void forming in the internal portion of the zinc collar by allowing the molten zinc to solidify from the lower portion of the mold upward.

Further object of this invention is to provide a mold having a simple structure suitable for forming a zinc collar on the insulator metal cap.

According to the method of forming a zinc collar on an insulator metal cap of this invention, a galvanized insulator metal cap, in order to attain the above objects, is set upright on a preheated top pouring type mold with the molten zinc substantially on the lower half surface of the metal cap being maintained in the molten state, and a molten zinc is poured from the top opening of the mold into the zinc collar molding cavity, followed by solidification of the molten zinc, whereby a zinc collar can integrally be formed from the lower external circumferential edge to the bottom of the metal cap.

Further, in the mold for forming such zinc collar on an insulator metal cap, a setting section is defined for fitting the metal cap upright onto the center of the upper mold body surface, and a zinc collar molding cavity opening upward is defined on the upper surface of the mold body around the periphery of the setting section.

The objects and features of the invention may be understood with reference to the following detailed description of illustrative embodiments of the invention, taken together with the accompanying drawings.

DESCRIPTION OF THE PREFERRED EMBODIMENTS

This invention will be described below by way of preferred embodiments. A first embodiment of the method of forming a zinc collar on an insulator metal cap and a mold to be used therefor of this invention will now be detailed referring to FIGS. 1 and 2.

In the first embodiment, a metal cap 4 having been formed by casting and subjected to pretreatment in the same manner as described in the prior art method before formation of a zinc collar 6 is first immersed in a molten zinc heated to about 440° to 500° C. to effect galvanizing. Subsequently, the thus treated metal cap 4 is removed from the molten zinc and immersed in about 10° to 70° C. water to cool and solidify the molten zinc formed on the metal cap surface.

Figure 5:
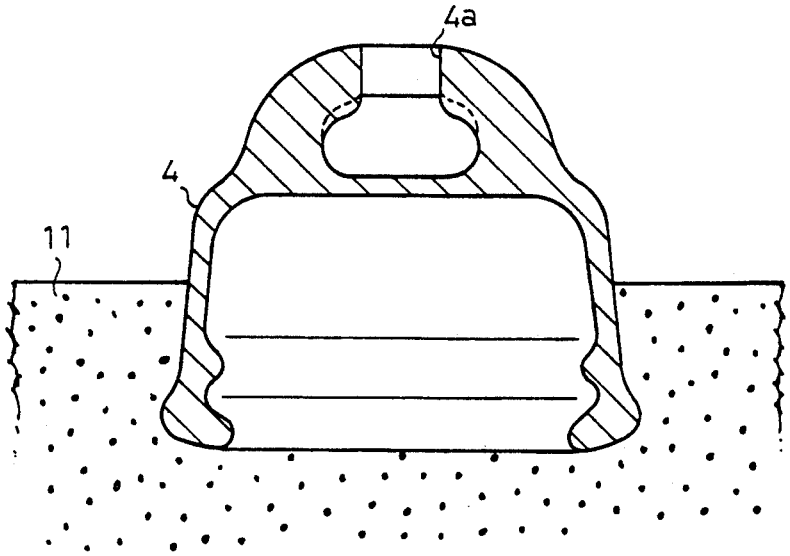
FIG. 5 (Prior art)
FIG. 5 shows, in cross section, heating of a metal cap according to the conventional zinc collar forming method.
Figure 4:
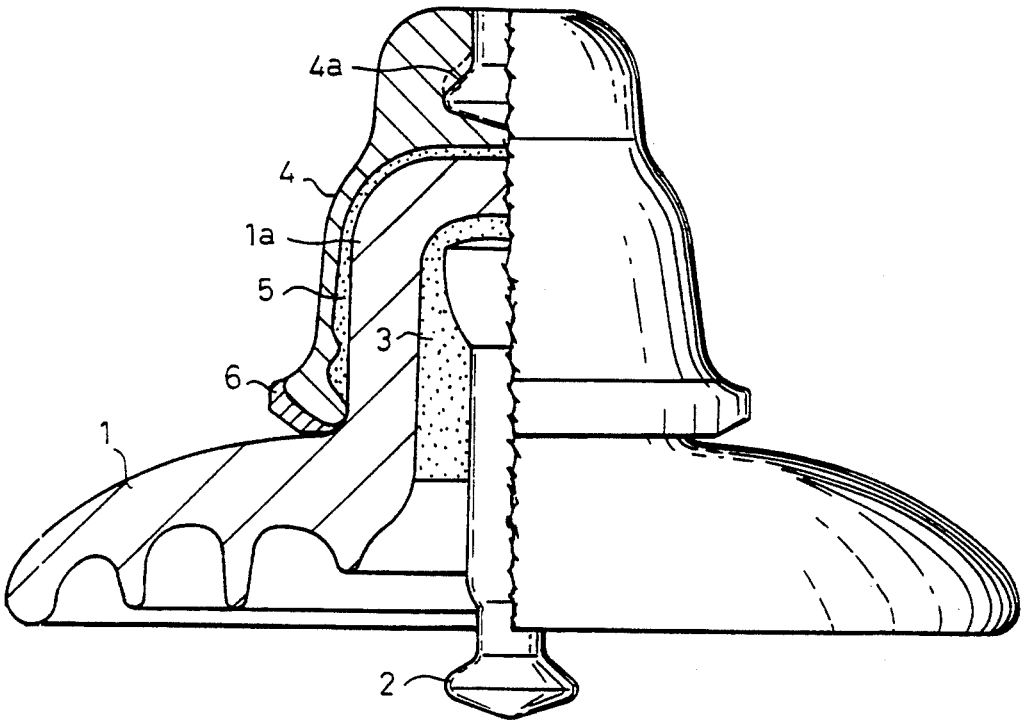
FIG. 4 shows, in partially cutaway front view of an illustrative suspension insulator.
Figure 6:
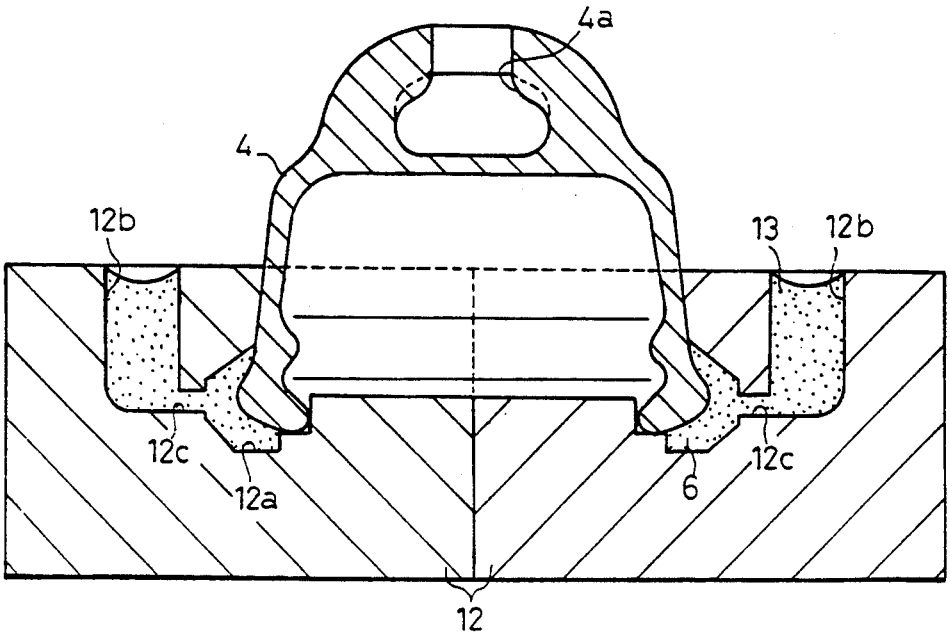
FIG. 6 (Prior art)
FIG. 6 shows, in cross section, a metal cap set on a mold which is used according to the conventional zinc collar forming method.

Next, the thus galvanized metal cap 4 is again immersed upright with the socket 4*a* facing upward in a molten zinc 11 heated to about 450° to 650° C. substantially in the same manner as in the conventional method as shown in FIG. 5 so that approximately the half of the entire height of the cap may be immersed in the molten zinc 11 to heat the immersed portion approximately to the same temperature.

Figure 1:
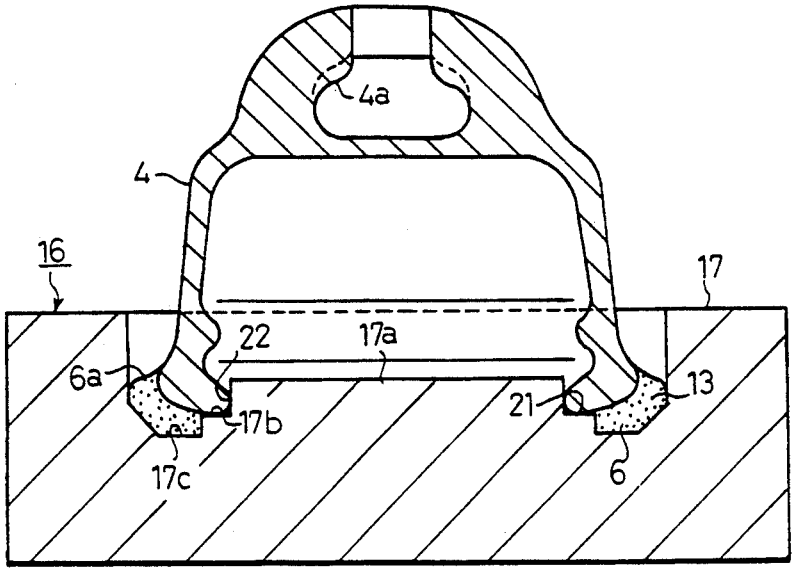
FIG. 1 shows, in cross section, a metal cap set on a mold to be used according to a first embodiment of the present method of forming a zinc collar on an insulator metal cap.

Subsequently, the metal cap 4 is removed from the molten zinc 11 and then set on a top pouring type mold 16, with the molten zinc 11 substantially on the lower half of the metal cap 4 being still in the molten state, as shown in FIG. 1, followed by formation of the zinc collar 6 on the metal cap 4.

Now, referring to the structure of the mold 16, the mold 16 has a block-shaped mold body 17, and a cylindrical protrusion 17*a* is defined at the center of the upper surface thereof with a step-form setting section 17*b* for fitting the metal cap 4 upright in position being defined around the periphery of the protrusion 17*a*. The setting section 17*b* has a horizontal supporting surface 21 for supporting the bottom of the metal cap 4 and a vertical control surface 22 which engages with the internal circumferential surface of the lower opening of the metal cap 4 and controls horizontal shifting of the metal cap 4.

An annular zinc collar molding cavity 17*c* opening upward is also defined on the upper surface of the mold body 17 around the periphery of the setting section 17*b*.

For forming the zinc collar 6, the mold 16 is heated to about 50° to 300° C., and the metal cap 4 is set upright on the setting section 17*b* of the mold body 17, as shown in FIG. 1, wherein the bottom of the metal cap 4 is placed on the supporting surface 21 and the internal circumferential surface of the lower opening of the metal cap 4 engages with the control surface 22, and thus the entire metal cap 4 is placed in position.

Figure 2:
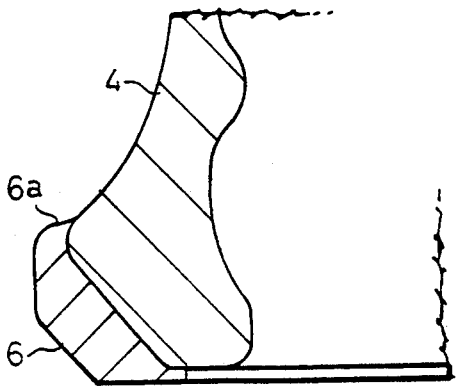
FIG. 2 shows, in partially enlarged cross section, a state where a zinc collar is formed on the metal cap.

In this state, a predetermined amount of molten zinc 13 is poured from the upper opening of the mold 17 into the zinc collar molding cavity 17*c*. The process of molding the zinc collar 6 is completed simply by releasing the metal cap 4 from the mold 16 after the molten zinc 13 in the cavity 17*c* is solidified. Thus, the annular zinc collar 6 can integrally be formed on the metal cap 4 from the lower circumferential edge to the bottom thereof as shown in FIG. 2.

In the first embodiment of forming the zinc collar 6, the zinc collar molding cavity 17*c* defined in the mold body 17 is opening upward, so that the molten zinc 13 poured into the cavity 17*c* starts to solidify from the portion on the bottom of the cavity 17*c* gradually upward and finally to the uppermost portion of the zinc collar 6. Accordingly, no voids will be formed in the internal portion of the zinc collar 6, and yield of products can be improved. Moreover, since the molten zinc 13 is poured onto the metal cap 4 when the molten zinc 11 layer formed on the external surface of the metal cap 4 is still in the molten state, the bond strength at the interface between the zinc collar 6 and the metal cap 4 can be improved.

Further, since the metal cap 4 is heated to a temperature usually higher than that of the mold 16, the zinc collar 6 comes to have a smooth upper surface 6*a* corresponding to the temperature gradient therebetween. Besides, no burring occurs that the conventional method using a mold having a gate suffers, so that intricate procedures such as deburring and finish surface polishing are not necessary. Compared with the conventional method, the amount of the molten zinc 13 to be used for the molding can be reduced to greatly lower the production cost.

Figure 3:
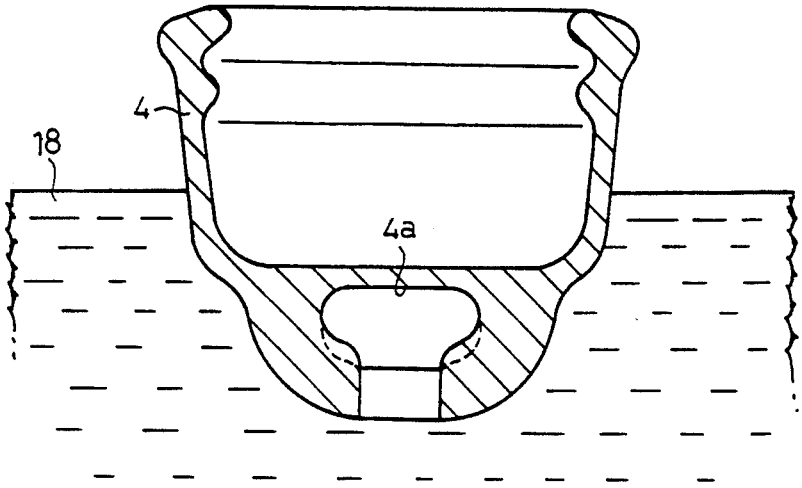
FIG. 3 shows, in cross section, cooling of the metal cap with water which will be used according to a second embodiment of the zinc collar forming method of this invention.

Next, a second embodiment of the present method of forming a zinc collar on an insulator metal cap will be described referring to FIGS. 1 and 3.

In the second embodiment, a metal cap 4 having been formed by casting and subjected to pretreatment in the same manner as in the first embodiment is first immersed in a molten zinc heated to about 440° to 500° C. to effect galvanizing. Subsequently, the thus treated metal cap 4 is removed from the molten zinc, and thus the surface of the metal cap 4 is entirely soaked with the molten zinc. Next, unlike in the first embodiment, the thus treated metal cap 4 is inverted and immersed in about 10° to 70° C. water 18 in such a way that substantially the upper half including the socket 4*a* of the metal cap 4 may be immersed in water 18, followed by cooling and solidification of the molten zinc substantially on the upper half surface. With the molten zinc substantially on the lower half of the metal cap 4 being still in the molten state, the metal cap 4 is removed from the water 18.

Then, in the same manner as in the first embodiment, the top pouring type mold 16 as shown in FIG. 1 is preheated and the metal cap 4 is set upright at the setting section 17*b* defined on the mold 16. A molten zinc 13 is poured from the upper opening of the mold 16 into the zinc collar molding cavity 17*c* to integrally form a zinc collar 6 on the metal cap 4 from the lower external circumferential edge to the bottom.

Accordingly, in the second embodiment, like in the first embodiment, no voids will be formed in the internal portion of the zinc collar 6, and thus yield of products can be improved. Besides, intricate processing such as debur ring and finish surface polishing are not necessary, unlike the conventional method using a mold having a gate, and the amount of the molten zinc 13 to be used for the molding can be reduced to greatly lower the production cost.

Further, to summarize the second embodiment of forming a zinc collar, a metal cap 4 is first galvanized, and then the molten zinc substantially on the upper half of the metal cap 4 is solidified. With the molten zinc on the lower half of the metal cap 4 being still in the molten state, and in this state a zinc collar 6 is formed on the lower circumferential portion of the metal cap 4. Accordingly, compared with the first embodiment of forming a zinc collar wherein a metal cap 4 is first galvanized; the molten zinc thus deposited on the entire surface is solidified by cooling; substantially the lower half of the thus treated metal cap 4 is again immersed in a molten zinc; and with the lower half being soaked with the molten zinc, a zinc collar 6 is formed along the lower circumferential edge of the metal cap 4, the second embodiment uses a simplified process for forming a zinc collar 6 and can further improve productivity.

In the second embodiment, since the molten zinc is solidified using water, formation of alloy layer at the interface between the material of the metal cap and zinc can be inhibited, whereby not only the bond strength between the metal cap 4 and the zinc collar forming molten zinc can be enhanced but also the metal cap 4 can be handled with ease.

The mold 16 for forming a zinc collar used in the above embodiments have a very simple structure, since the setting section 17*b* for setting the metal cap 4 in position and the zinc collar molding cavity 17*c* are defined on the upper surface of the single mold 17, and the mold requires no high-accuracy approaching/separating mechanism unlike in the conventional method where a pair of die halves are used. Accordingly, the mold constitution can be simplified.

While the invention has been particularly shown and described in reference to preferred embodiments thereof, it will be understood by those skilled in the art that changes in form and details may be made therein without departing from the spirit and scope of the invention.

What is claimed is:

1. A mold for forming a zinc collar on an external periphery of a metal cap, comprising:

a mold body;

a setting section for fitting said metal cap upright in position on the upper surface of said mold body, said setting section being means for supporting the bottom of the metal cap and engaging with an internal surface of an opening of the metal cap, wherein said setting section comprises a supporting surface means for supporting the bottom of said metal cap and a control surface means for engaging the internal peripheral portion of the opening of said metal cap to control a setting position of said metal cap; and a zinc collar molding cavity having a bottom portion, said zinc collar molding cavity being defined to open upward from the upper surface of the mold body around the periphery of said setting section means, wherein said bottom portion of said cavity is below said supporting surface of said setting section means, wherein said internal surface of the metal cap, other than said internal surface of the opening thereof, is unsupported, and wherein an external surface of the metal cap, other than the bottom thereof, is unsupported.

* * * * *